US005819552A

United States Patent [19]

Lee

[11] Patent Number: 5,819,552

[45] Date of Patent: Oct. 13, 1998

[54] AIR-CIRCULATED REFRIGERATOR

[75] Inventor: Yong-Kweon Lee, Incheon, Rep. of Korea

[73] Assignee: Daewoo Electronics Co., Ltd., Seoul, Rep. of Korea

[21] Appl. No.: 823,481

[22] Filed: Mar. 25, 1997

[30] Foreign Application Priority Data

Jun. 29, 1996 [KR] Rep. of Korea ..... 96-26120

[51] Int. Cl.[6] ..... F25D 17/04

[52] U.S. Cl. ..... 62/407; 62/441

[58] Field of Search ..... 62/440, 441, 407, 62/408, 447

[56] References Cited

U.S. PATENT DOCUMENTS

| | | | |
|---|---|---|---|
| 4,704,874 | 11/1987 | Thompson et al. . | |
| 4,741,175 | 5/1988 | Schulze . | |
| 4,944,157 | 7/1990 | Jenkins et al. | 62/407 |
| 5,433,086 | 7/1995 | Cho et al. . | |

*Primary Examiner*—John M. Sollecito
*Attorney, Agent, or Firm*—Cushman Darby & Cushman Intellectual Property Group of Pillsbury Madison & Sutro, LLP

[57] ABSTRACT

An air-circulated refrigerator in which a conventional separate partition, in which air passages are formed is unnecessary, so that it can be assembled easily and promptly and the freezer and refrigerating compartments are space efficient. An evaporator and fans are installed to an air duct assembly. The air duct assembly has a main air duct, an air duct cover, an air duct insulation member and air guide ducts. In the main duct, air passages are formed. One end of each of the air guide ducts is inserted into and communicated with each of the corresponding air passages, and the other end of each of the air guide ducts is inserted into each of the openings of the refrigerating compartment so as to be communicated with the refrigerating compartment. The air introduced into the refrigerating compartment, after circulating in the refrigerating compartment, returns to the evaporator through the opening formed in the upper portion of the rear wall of the refrigerating compartment and the opening of the air duct cover which is communicated therewith. The air duct cover has an opening for supplying the cooled air to the freezer compartment through an opening of the freezer compartment. After circulating in the freezer compartment, and the air returns to the evaporator through the openings formed adjacent to each of the rear corners at the bottom surface of the freezer compartment and through the openings of the air duct cover which are communicated with the opening of the freezer compartment.

17 Claims, 9 Drawing Sheets

AIR-CIRCULATED REFRIGERATOR

BACKGROUND OF THE INVENTION

1. Field of the Invention

The present invention relates to a refrigerator, and more particularly to an air-circulated refrigerator which has an improved cooled air duct assembly which can be easily and quickly installed to an inner box of the refrigerator.

2. Description of the Prior Art

Generally, refrigerators are used to store foodstuffs in either a frozen or a refrigerated condition for a long period of time.

Refrigerators can be classified into direct cooling refrigerators and indirect cooling (or air-circulated) refrigerators by their cooling method. In a direct cooling refrigerator, since an evaporator is directly installed in a freezer or a refrigerating compartment, heat-exchanges are directly and effectively achieved between stored foodstuffs and the evaporator. However, in the direct cooling refrigerator, the cooling speeds of the foodstuffs vary according to their stored positions, and frost generated in the refrigerator is not easily removed. Therefore, an air-circulated refrigerator is widely used as a household refrigerator, especially as a large-scale refrigerator.

In an air-circulated refrigerator, an evaporator is installed in an air passage instead of in a freezer or a refrigerating compartment. The air passing through the air passage is cooled by the evaporator and then the cooled air is blown and introduced by fans into the freezer and refrigerating compartments and returns to the evaporator after accomplishing heat-exchanges with the stored food-stuffs.

The air cooled by the evaporator is introduced into the freezer and refrigerating compartments to maintain the temperature of each compartment at a predetermined value so that the foodstuffs can be stored in a desired condition, and is flowed through air passages back to the evaporator after being exhausted from the compartments.

Examples of the above-mentioned air passages are disclosed in U.S. Pat. No. 4,704,874 issued to Thompson et al on Nov. 10, 1987 with the title of "Household Refrigerator Air Flow System", in U.S. Pat. No. 4,741,175 issued to James L. Schulze on Feb. 14, 1988 and entitled "Auto Defrost Refrigerator" and in U.S. Pat. No. 5,433,086 issued to Cho et al on Jul. 18, 1995 and assigned to the assignee of the present invention, and entitled "Refrigerator Having Independent Temperature Control of Plural Compartments".

Hereinafter, a conventional air-circulated refrigerator particularly having two fans, one for a freezer compartment and the other for a refrigerating compartment, and the structure and air circulations thereof will be explained.

FIGS. 1 through 3 illustrate a conventional air-circulated refrigerator. FIG. 1 is a longitudinal sectional view for illustrating cooled air circulation of the refrigerator. FIGS. 2 and 3 are exploded perspective views for illustrating the assembly process of the refrigerator.

Referring to FIG. 1, the conventional air-circulated refrigerator includes an outer box 40 and an inner box 80 in which freezer and refrigerating compartments are formed. The freezer compartment 10 is defined by upper and side surfaces of the inner box 10, a freezer compartment case 14, and an upper surface of a partition 20. The refrigerating compartment 30 is positioned below and separated by the partition 20 from the freezer compartment 10. The partition 20 is made of or filled with a heat-insulating material to reduce the heatexchange between the freezer and refrigerating compartments 10 and 30. Formed in the partition 20 are first and second air ducts 60 and 62 for exhausting the cooled airs in the freezer and refrigerating compartments 10 and 30 respectively. An evaporator 50 is installed at a position between a back surface of the refrigerating compartment case 14 and the outer box 40, and air is cooled while passing through the evaporator. At a position above the evaporator 50 are provided first and second fans 70A and 70B for respectively introducing the air cooled in the evaporator 50 into the freezer and refrigerating compartments 10 and 30. In the partition 20 between the freezer and refrigerating compartments 10 and 30 are formed the first and second cooled air ducts 60 through which the cooled airs respectively exhausted from the freezer and refrigerating compartments 30 are flowed back to the evaporator 50. A third cooled air duct 64 is formed at a rear side position from the first and second cooled air ducts 60 and 62 and provides a passage through which the cooled airs exhausted through the first and second cooled air ducts 62 are mixed and flowed back to the evaporator 50. Between the evaporator 50 and the outer box 40 is installed a fourth cooled air duct 66 so as to provide a passage through which the cooled air is flowed into the interior of the refrigerating compartment 30.

The cooled airs generated by the evaporator 50 are introduced by the first and second fans 70A and 70B into the interiors of the freezer and refrigerating compartments 10 and 30 respectively. The cooled air introduced into the freezer compartment 10 is heat-exchanged with the stored foodstuffs, and is flowed into the first cooled air duct 60 through a first cooled air inlet 12 formed in the bottom surface of the freezer compartment 10, and then is exhausted through the first cooled air duct 60. The cooled air introduced through the fourth cooled air duct 66 into the interior of the refrigerating compartment 30 is exhausted through a second cooled air inlet 32 formed in the upper surface of the refrigerating compartment 30 and through the second cooled air duct 62 after being heat-exchanged with the foodstuffs stored in the refrigerating compartment 30. The cooled airs exhausted through the first and second cooled air duct 60 and 62 are mixed in the third cooled air duct 64 and are introduced into the evaporator 50 again so as to be cooled. During the cooling process, the moisture contained in the cooled air is changed into frost and sticks to the evaporator 50. The frost on the evaporator is heated into water by a heater 68 installed below the evaporator 50, and the water is exhausted outside the refrigerator through the drain pipe 69 installed below the third cooled air duct 68.

FIGS. 2 and 3 are exploded perspective views for respectively illustrating the assembled states of the inner and outer boxes of the refrigerator.

Referring to FIGS. 2 and 3, the assembling process of the conventional air-circulated refrigerator will be explained. Firstly, the partition in which the first and second air ducts 60 and 62 are provided and inserted into a space between the lower surface of the freezer compartment 10 and the upper surface of the refrigerating compartment 30.

The fourth air duct is then installed on the rear surface of the inner box 80. Thereafter the inner box assembly is fitted into the flange of the refrigerator, and the evaporator is then assembled on the rear wall of the inner box 80 at the front surface of the rear wall 80. The outer box rear plate 42 is mounted by screws on the outer box 40. Thereafter, at the upper side of the evaporator 50, the first and second fans 70A and 70B for respectively introducing the cooled airs into the freezer and refrigerating compartments are mounted on the rear wall of the freezer compartment 10. And then, the insulation member 15 for insulating the freezer compartment 10 from the evaporator 50 is installed in front of the evaporator 50.

However, in the above-mentioned conventional refrigerator, since the air duct 90, the evaporator 50, the insulation member 15, and the freezer compartment case are separately assembled, the assembling process of the refrigerator is complicated and time-consuming. Further, in the refrigerator, the partition 20 for providing the first and second air duct 60 and 62 is additionally needed between the freezer and refrigerating compartments 10 and 30. In addition, since a space is needed for inserting the partition 20 between the freezer and refrigerating compartments 10 and 30, the freezer and refrigerating compartments are not space-efficient.

On the other hand, the heat-transfer coefficient of the insulation material of the partition 20 is about twice as large as that of polyurethane, which is generally used as an insulating layer, so the insulation between the freezer and refrigerating compartments cannot be efficiently accomplished.

SUMMARY OF THE INVENTION

The present invention is intended to overcome the above described disadvantages. Therefore, it is an object of the present invention to provide an air-circulated refrigerator in which a conventional separate partition in which air passages are formed is unnecessary so that it can be assembled easily and promptly and the freezer and refrigerating compartments are space-efficient.

In order to achieve the above object of the present invention, there is provided an air-circulated refrigerator comprising: an outer box having a substantially box-like shape with the front side thereof open; an inner box provided in the outer box and having a substantially box-like shape with the front side thereof open, the inner box having an upper space and a lower space defined by a partitioning portion integrally formed therewith and filled with an insulation material, the lower space forming a refrigerating compartment, and the insulation material being filled between the inner and outer boxes; a freezer compartment case provided in the upper space, for defining a freezer compartment in the upper space by an upper surface of the inner box, side surfaces of the inner box, and an upper surface of the partitioning portion; an evaporator installed in the upper space and at the rear side of the freezer compartment case, for cooling air by using a refrigerating cycle; first and second fans installed above the evaporator, for respectively blowing the cooled air into the freezer and refrigerating compartments; and an air duct assembly for providing air passages through which the cooled air is introduced into the freezer and refrigerating compartments.

In order to effectively attain the insulation effect, the insulation material is preferably comprised of polyurethane.

The freezer compartment has a first opening located at an upper portion of a rear wall of the freezer compartment, through which the cooled air is introduced into the freezer compartment by the first fan, and has second openings respectively located adjacent to each rear corner of the bottom surface of the freezer compartment, through which the cooled air circulated in the freezer compartment returns to the evaporator. The refrigerating compartment has: third openings located in each side wall of the refrigerating compartment, through which the cooled air is introduced into the refrigerating compartment by the second fan; and a fourth opening located at an upper portion of a rear wall of the refrigerating compartment, through which the cooled air circulated in the refrigerating compartment returns to the evaporator.

The air duct assembly has a main air duct on which the evaporator is mounted and an air duct cover engaged with the main air duct, the first and second fans being installed at the rear side of the air duct cover. The main air duct has air passages bifurcated and extended from an upper end of the main air duct to a lower end of the main air duct so that the cooled air is flowed therethrough to the refrigerating compartment and has engaging portions formed at upper, right, and left edges of the main air duct, for engaging with the air duct cover.

The air duct assembly further has an air duct insulation member inserted into the air passages such that an upper plane thereof is levelled with an upper plane of the main air duct, for reducing the heat-transfer between the evaporator and the cooled air in the air passages of the main air duct. The air duct assembly may further include right and left air guide ducts, in which a first end of each of the air guide ducts is inserted into and communicated with each of the corresponding air passages at right and left lower corner portions of the main air duct, and a second end of each of the air guide ducts is inserted into each of the third openings of the refrigerating compartment so as to be communicated with the refrigerating compartment.

The air duct cover has a fifth opening located at an left upper portion of the air duct cover, the fifth opening being connected to and communicated with the first opening; sixth openings located at each side of a lower portion of the air duct cover, the sixth openings being respectively connected to and communicated with the corresponding second openings; and a seventh opening located in the middle of the lower portion of the air duct cover and connected to and communicated with the fourth opening.

Holes are respectively formed in the engaging portions of the main air duct, the air duct cover having hook members respectively located at positions corresponding to the engaging portions so as to be engaged with the corresponding holes of the engaging portions.

The air duct assembly further comprises an air duct cover insulation member attached to the rear surface of the air duct cover to insulate the air duct cover from the evaporator so that generation of frost on the surfaces of the air duct cover is prevented. The air duct cover insulation member has eighth openings located at each side of a lower portion of the air duct cover insulation member, the eighth openings being connected to and communicated with the corresponding sixth openings formed in the air duct cover; and a ninth opening located in the middle of the lower portion of the air duct cover insulation member, the ninth opening being connected to and communicated with the seventh opening formed in the air duct cover.

Firstly, the evaporator is mounted by screws to the through-holes formed at the upper and lower portions of both sides of the main air duct. Thereafter, the first and second fans and are installed in the main duct to which the evaporator is mounted. One end of each of air guide ducts is inserted into the air passages and at each of the right and left lower corner portions of the main air duct, and the other end thereof is inserted into the third openings formed at the right and left side walls of the refrigerating compartment. After the air duct cover insulation member is interposed between the main air duct and the air duct cover, the air duct cover is engaged with the main air duct.

The refrigerator according to the present invention does not need a conventional separate partition having air passages formed therein so that it can be assembled easily and promptly. Further, instead of the conventional partition, a partitioning portion filled with an insulation material is provided between the freezer and refrigerating compartments so the compartments are effectively insulated.

BRIEF DESCRIPTION OF THE DRAWINGS

The above object and other advantages of the present invention will become more apparent by describing in detail a preferred embodiment thereof with reference to the attached drawings in which.

DETAILED DESCRIPTION OF THE INVENTION

Hereinafter, an air-circulated refrigerator according to a preferred embodiment of the present invention will be explained in more detail with reference to the accompanying drawings.

Figure 1:
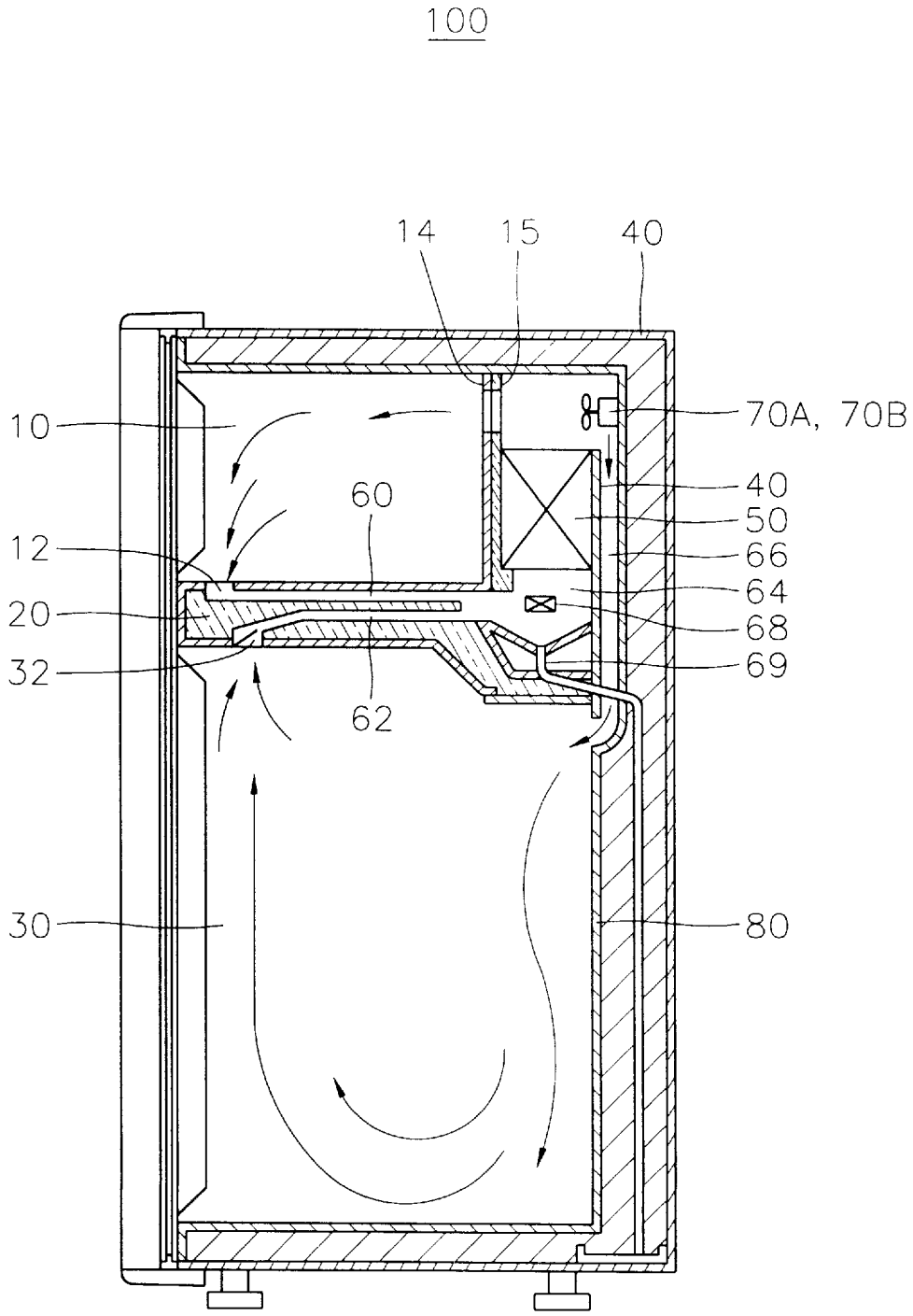
FIG. 1 (PRIOR ART)
FIG. 1 is a longitudinal-sectional view for illustrating circulation a structure of a conventional air-circulated refrigerator.
Figure 2:
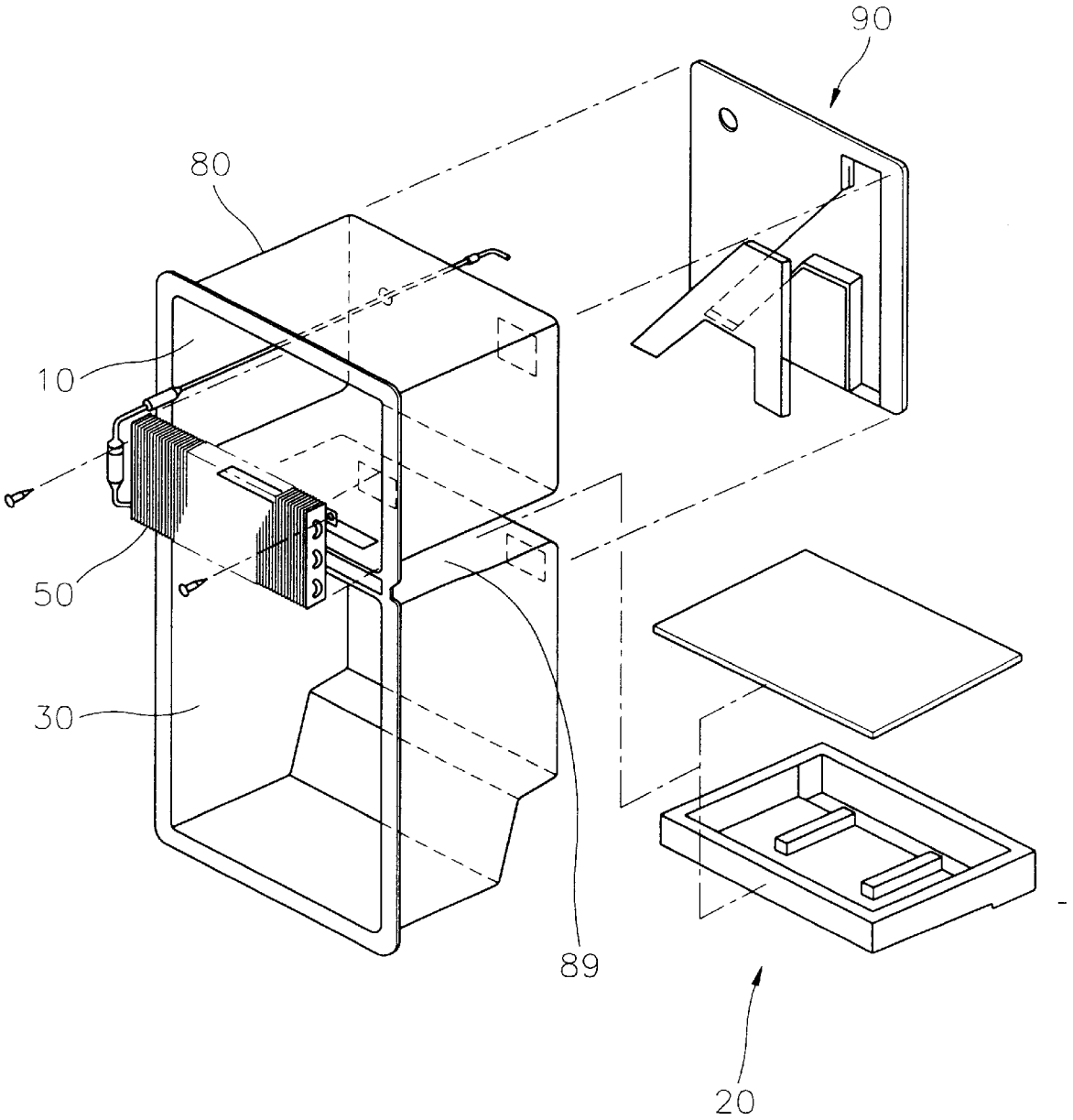
FIG. 2 (PRIOR ART)
FIG. 2 is an exploded perspective view for showing elements assembled to an inner box of the refrigerator shown in FIG. 1.
Figure 3:
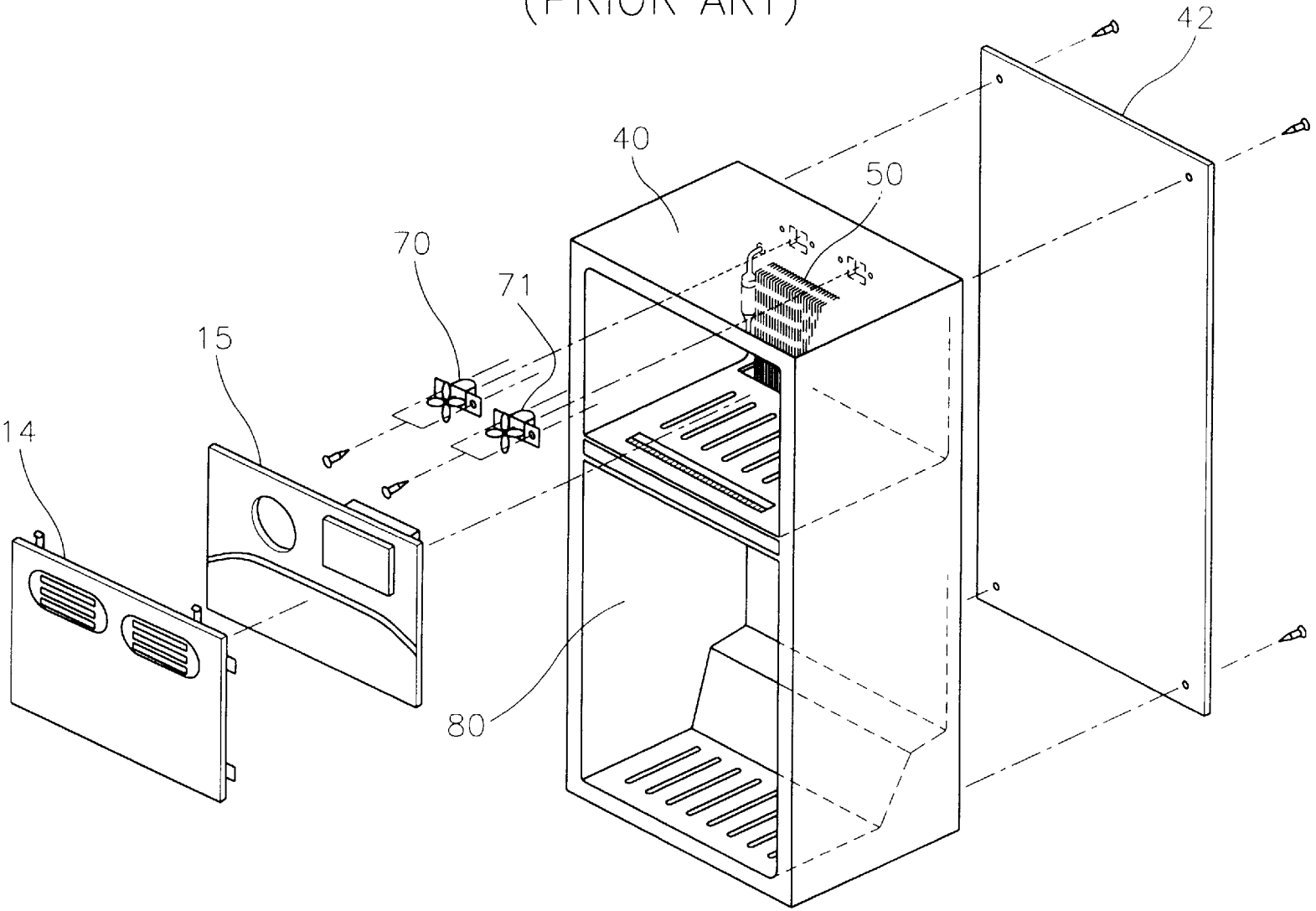
FIG. 3 (PRIOR ART)
FIG. 3 is an exploded perspective view for showing elements assembled to an inner box of the refrigerator shown in FIG. 1.
Figure 4:
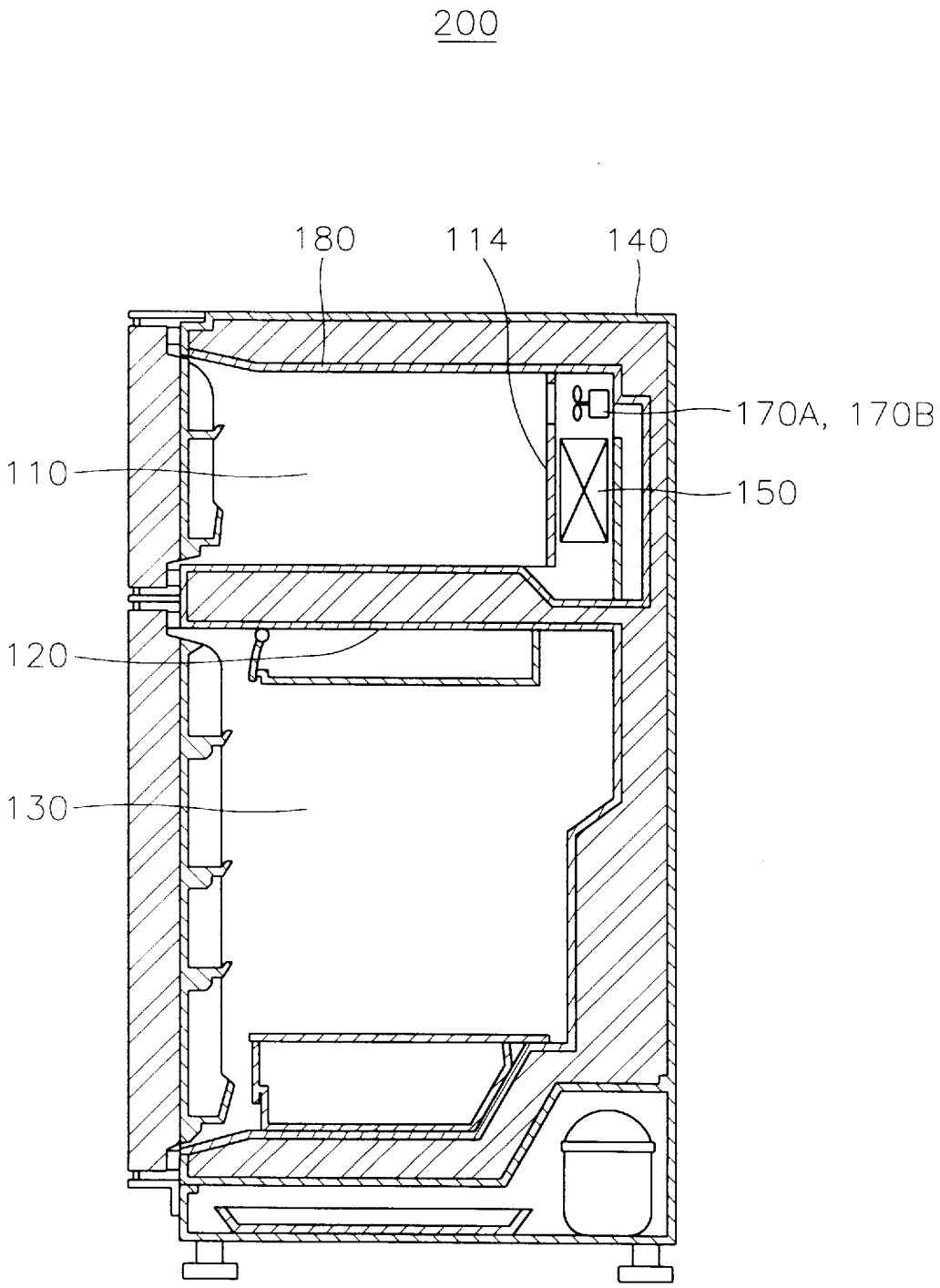
FIG. 4 is a longitudinal-sectional view of an air-circulated refrigerator according to one embodiment of the present invention.
Figure 5:
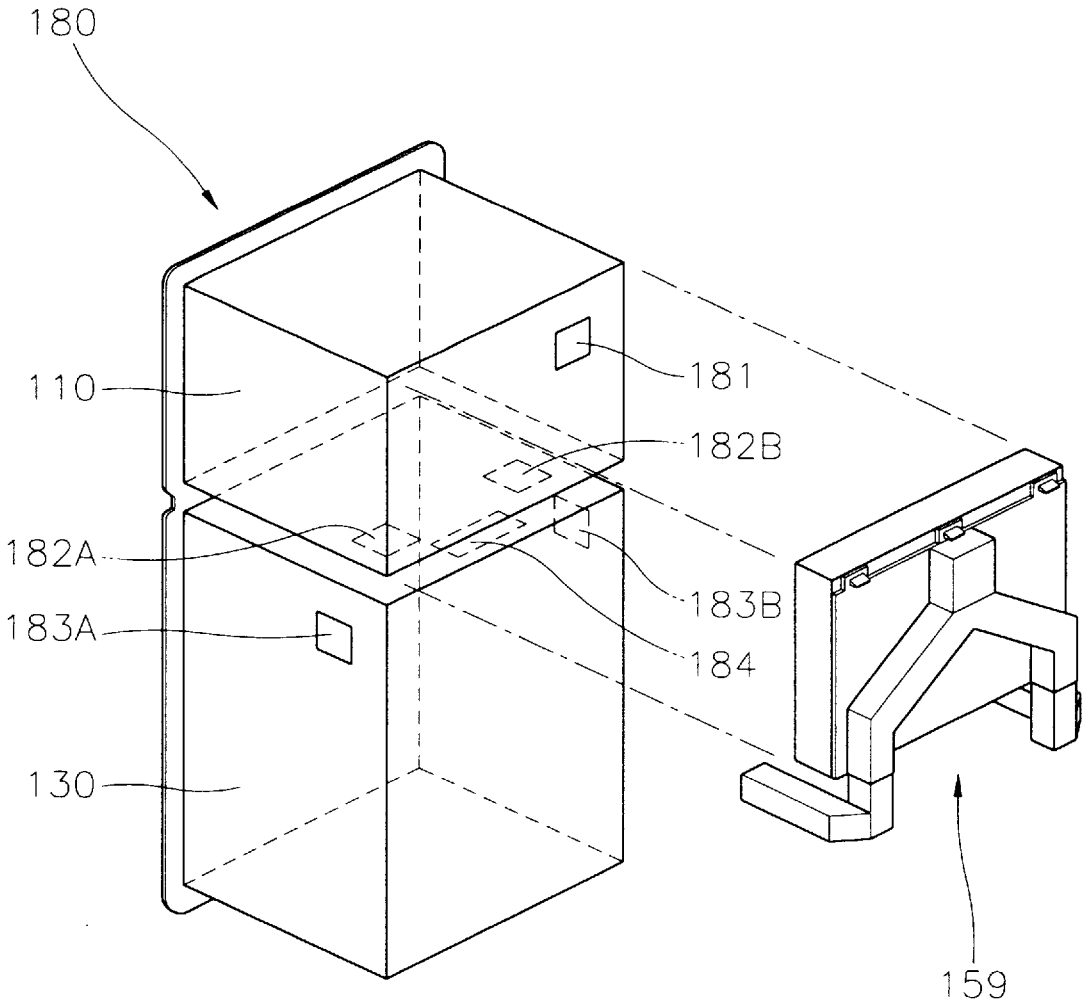
FIG. 5 is an exploded perspective view for illustrating the attachment of an air duct assembly to a rear surface of an inner box of the refrigerator shown in FIG. 4.

FIG. 4 is a longitudinal-sectional view for showing the refrigerator according to the present invention, and FIG. 5 is an exploded perspective view for schematically showing an air duct assembly of the refrigerator of FIG. 5.

Referring to FIGS. 4 and 5, an air-circulated refrigerator 200 according to a preferred embodiment of the present invention includes an outer box 140 and an inner box 180 installed in the interior of the outer box 140 so as to form freezer and refrigerating compartments 110 and 130. Installed the outer box 140 is an inner box which has a substantially box-like shape with its front side open and has a partitioning portion 120 integrally formed therewith, and in which upper and lower spaces thereof are defined by the partitioning portion 120. The freezer compartment 110 is defined inside the upper space by the upper and side surfaces of the inner box 180, a refrigerating compartment case 114, and the upper surface of the partitioning portion 120. At the rear side of the refrigerating compartment case 114 is installed an evaporator 150 and first and second fans 170A and 170B. An insulation is filled between the inner and outer boxes 180 and 140 and in the interior of the partitioning portion 120 of the inner box 180 in order to minimize the heat-transfer generated between the freezer and refrigerating compartments 110 and 130 and the outside of the refrigerator 200. In the preferred embodiment of the present invention, as an insulation material, polyurethane is used to efficiently accomplish the insulation. The evaporator for cooling air using a refrigerating cycle is installed between the refrigerating compartment case 110 and the outer box 140. At positions above the evaporator 150 are installed the first and second fans 170A and 170B for blowing cooled airs generated through the evaporator 150 into the freezer and refrigerating compartments 110 and 130. At the rear side of the evaporator 150 is provided an air duct assembly 159 for providing passages through which the airs generated through the evaporator 150 are introduced into the freezer and refrigerating compartments 110 and 130.

As shown in FIG. 5, a first opening 181 through which the air which has been passed through the evaporator 150 is flowed into the freezer compartment 110 by the first fan 170A, is formed at one side of the upper portion of the rear wall of the freezer compartment 110, and second openings 182A and 182B, through which the air which has been circulated in the freezer compartment 110 returns to the evaporator 150, are respectively formed adjacent to each of the rear corners at the bottom surface of the freezer compartment 110. In the right and left walls of the refrigerating compartment 110, third openings 183A and 183B, through which the air cooled by the evaporator 150 is introduced, are formed. In an upper portion of the rear wall of the refrigerating compartment 110, a fourth opening 184 through which the air which has been circulated in the refrigerating compartment 110 returns to the evaporator 150, is formed.

FIGS. 6 through 10 shows the air duct assembly according to the present invention. Referring to the figures, the air duct assembly 159 provides passages through which the cooled air is circulated, and includes the evaporator 150 and the first and second fans 170A and 170B. The air duct assembly 159 is installed in the inner box 180 at the rear side of the refrigerating compartment case 114.

Figure 6:
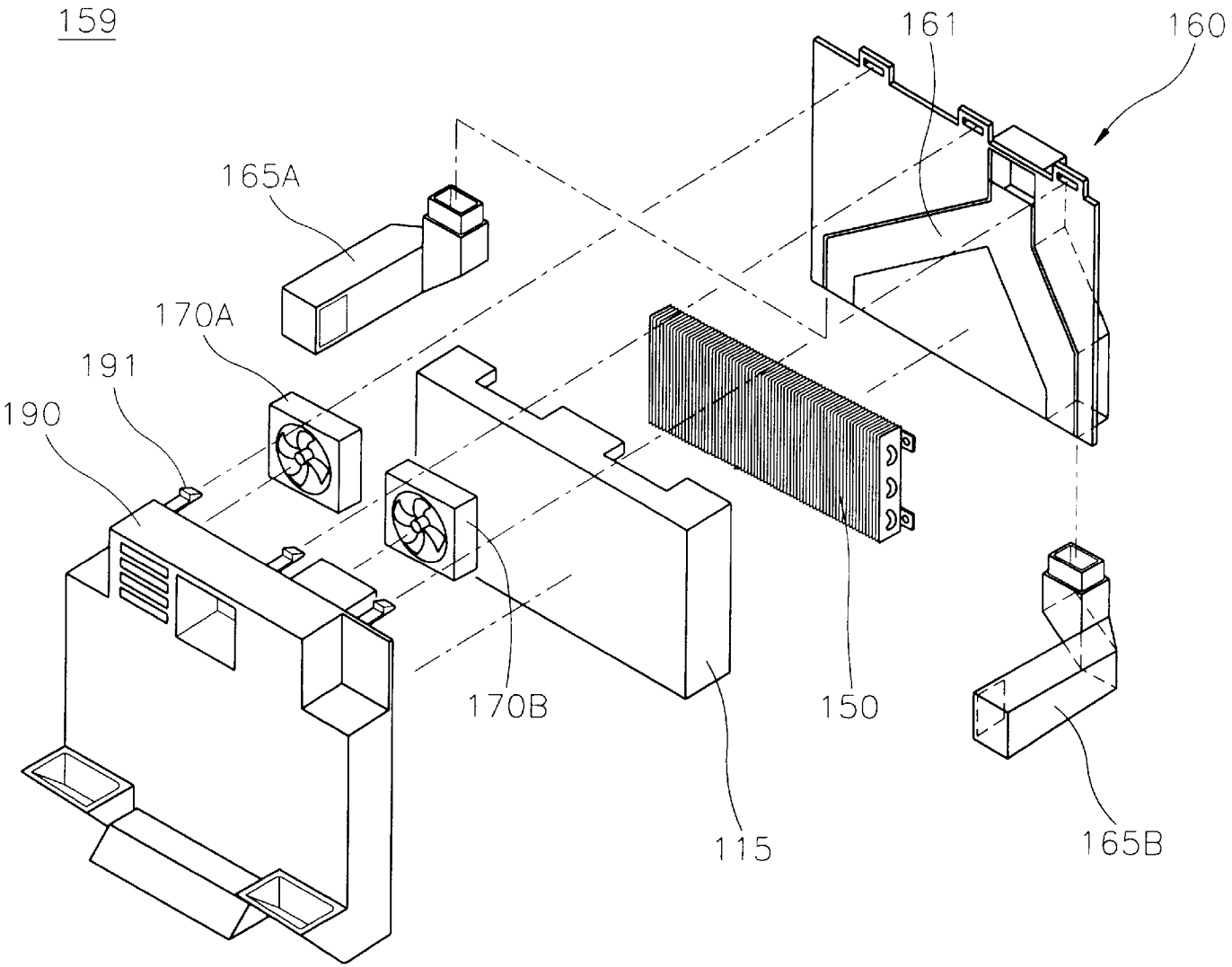
FIG. 6 is an exploded perspective view for showing elements of the air duct assembly assembled to the rear surface of the inner box of the refrigerator as shown in FIG. 4.

Especially referring to FIG. 6, the air duct assembly 159 of the refrigerator 200 according to the present invention comprises a main air duct 160, an air duct insulation member 161, right and left guide ducts 165A and 165B, the evaporator 150, an air duct cover 190, an air duct cover insulation member 115, and the first and second fans 170A and 170B.

Figure 7:
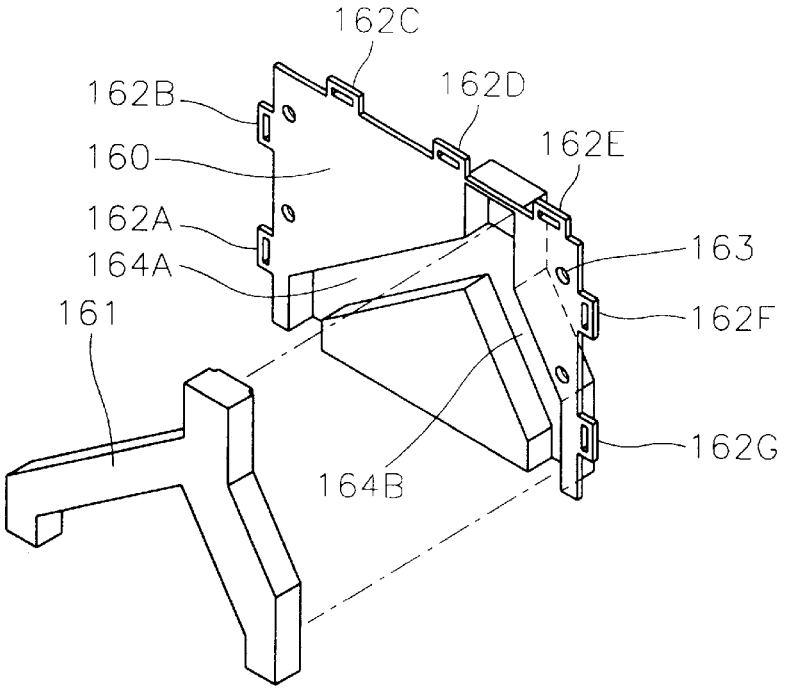
FIG. 7 is an exploded perspective view for showing a main air duct and an air duct insulation member of the air duct assembly shown in FIG. 6.

As shown in FIG. 7, the main air duct 160 substantially is a rectangular plate, and in the main air duct 160 are formed air passages 164A and 164B which are bifurcated and extended from the upper end of the main air duct 160 to the lower end of the main air duct 160 so that the cooled air generated in the evaporator 150 is flowed therethrough to the refrigerating compartment 110. The main air duct 160 is fixed to the air duct cover 190 by engaging hook members 191 of the air duct cover 190 with engaging portions 162A, 162B, 162C, 162D, 162E, 162F, and 162G formed at the upper, the right, and the left edges of the main air duct 160. The evaporator 150 is mounted by screws to through-holes 163 formed at the upper and lower portions of the either side of the main air duct 160. The right and left air guide ducts 165A and 165B are inserted upward into the air passages 164A and 164B formed in the main air duct 160. An air duct insulation member 161 is inserted into the air passages 164A, 164B such that the upper plane of the air duct insulation member 161 is levelled with the upper plane of the main air duct 160. The heat-transfer coefficient of the air duct insulation member 161 should be sufficiently small enough to minimize the heat-transfer between the evaporator 150 and the cooled air in the air passages 164A and 164B, so polyurethane is used in the preferred embodiment of the present invention to satisfy the above-mentioned requirement.

Figure 8:
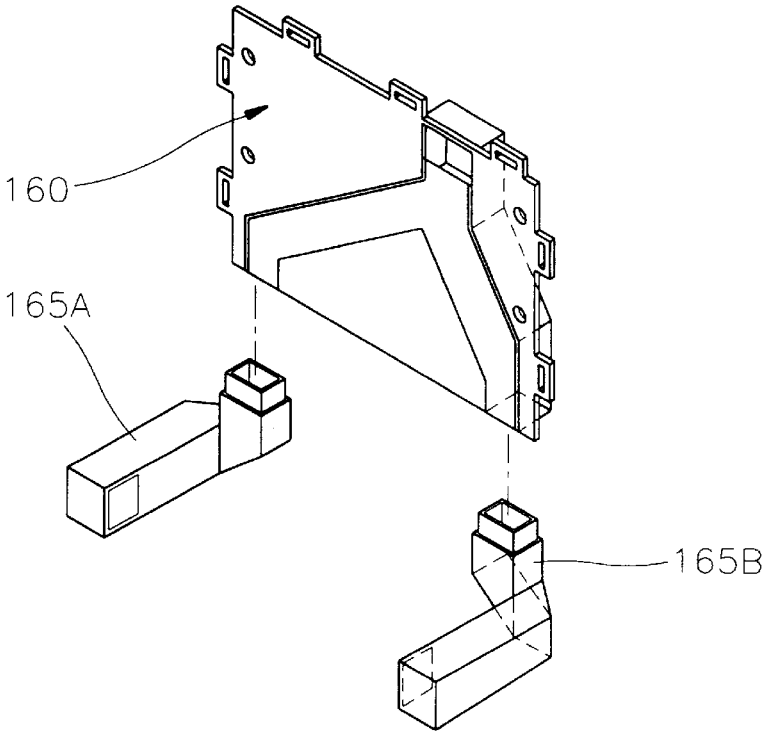
FIG. 8 is an exploded perspective view for showing an air guide duct shown in FIG. 6.

As shown in FIG. 8, the right and left air guide ducts 165A and 165B are symmetrically disposed. One end of each of air guide ducts 165A and 165B is inserted into and communicated with the air passages 164A and 164B at each of the lower right and left corner portions of the main air duct 160, and the other end thereof is inserted into and communicated with the third openings 183A and 183B formed at the right and left side walls of the refrigerating compartment 130.

Figure 9:
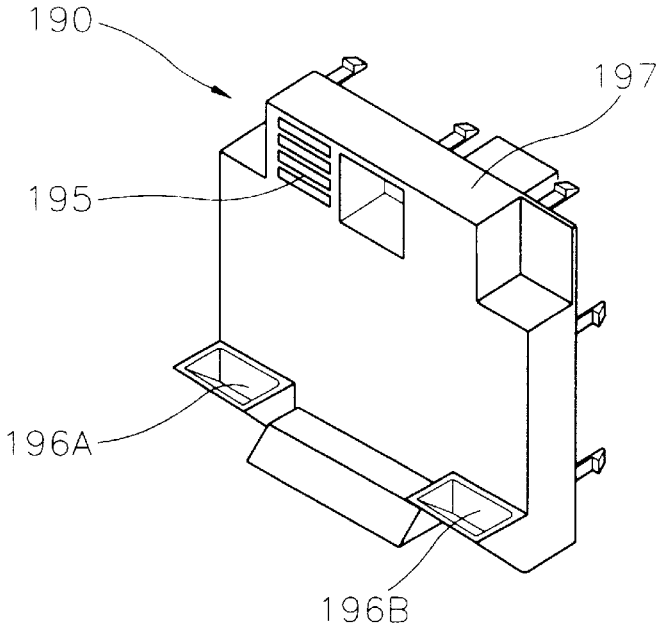
FIG. 9 is an exploded perspective view for showing an air duct cover shown in FIG. 6.

FIG. 9 shows the air duct cover of the air-circulated refrigerator according to the present invention. At the upper left portion of the air duct cover 190 is formed a fifth opening 195 which is connected to and communicated with the first opening 181 of the inner box 180. On the rear side of the air duct cover 190 is installed the first fan 170A for introducing into the refrigerating compartment 110 the air which has been passed through the evaporator 150. At the lower portions of both side of the air duct cover 190 are formed sixth openings 196A and 196B which are respectively connected to and communicated with the second openings 182A and 182B located at the rear sides of the bottom surface of the freezer compartment 110. At the rear side of the upper right portion of the air duct cover 190 is installed the second fan 170B for introducing into the refrigerating compartment 130 the cooled air generated in the evaporator 150. In the middle of the lower portion of the air duct cover 190 is formed a seventh opening 198 which is connected to and communicated with the fourth opening 184 located in the upper surface of the refrigerating compartment 130. The main air duct 160 is fixed to the air duct cover 190, by engaging hook members 191 of the air duct cover 190 with engaging portions 162A, 162B, 162C, 162D, 162E, 162F, and 162G formed at the upper, the right, and the left edges of the main air duct 160.

Figure 10:
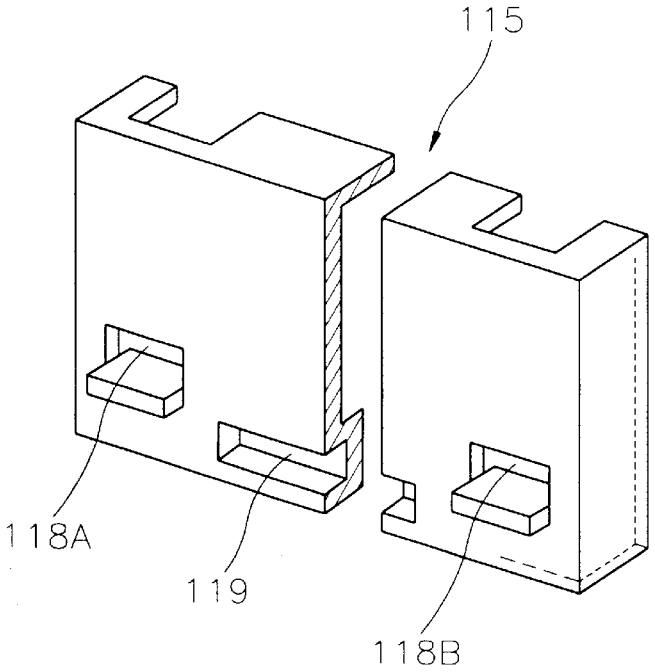
FIG. 10 is an exploded perspective view for showing an air duct cover insulation member shown in FIG. 6.

FIG. 10 shows the air duct cover insulation member, which insulates the air duct cover from the evaporator. The air duct cover insulation member 115 insulates the air duct cover 190 from the evaporator 150 so that the generation of the frost on the surfaces of the air duct cover 190 is prevented. At both sides of the lower portion of the cover insulation member 115 are formed eighth openings 118A and 118B which are connected to and communicated with the sixth openings 196A and 196B formed in the air duct cover 190, and in the middle of the lower portion thereof is formed a ninth opening 119 which is connected to and communicated with the seventh opening 198 formed in the air duct cover 190. The cover insulation member 115 is attached to the rear surface of the air duct cover 190.

Figure 11:
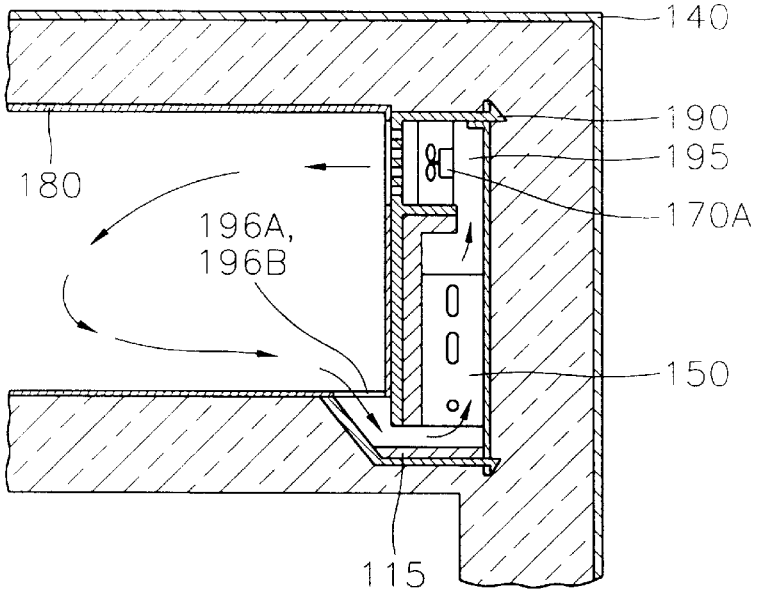
FIG. 11 is a longitudinal-sectional view for showing air circulation in a freezer compartment of the refrigerator according to the present invention.

The air circulation in the air-circulated refrigerator 200 of the present invention is as follows. FIG. 11 is a longitudinal-sectional view for showing air circulation in a freezer compartment of the refrigerator. Referring to FIG. 11, the cooled air which has passed through the evaporator 150 is introduced through the fifth opening 195 of the air duct cover 190 and the first opening 181 of the inner box 180 into the freezer compartment 110 by the first fan 170A installed at the rear side of the upper portion of the air duct cover 190. After circulating in the freezer compartment 110, the air returns to the evaporator 150 through the second openings 182A and 182B formed adjacent to each of the rear corners of the bottom surface of the freezer compartment 110 and also through the sixth openings 196A and 196B.

Figure 12:
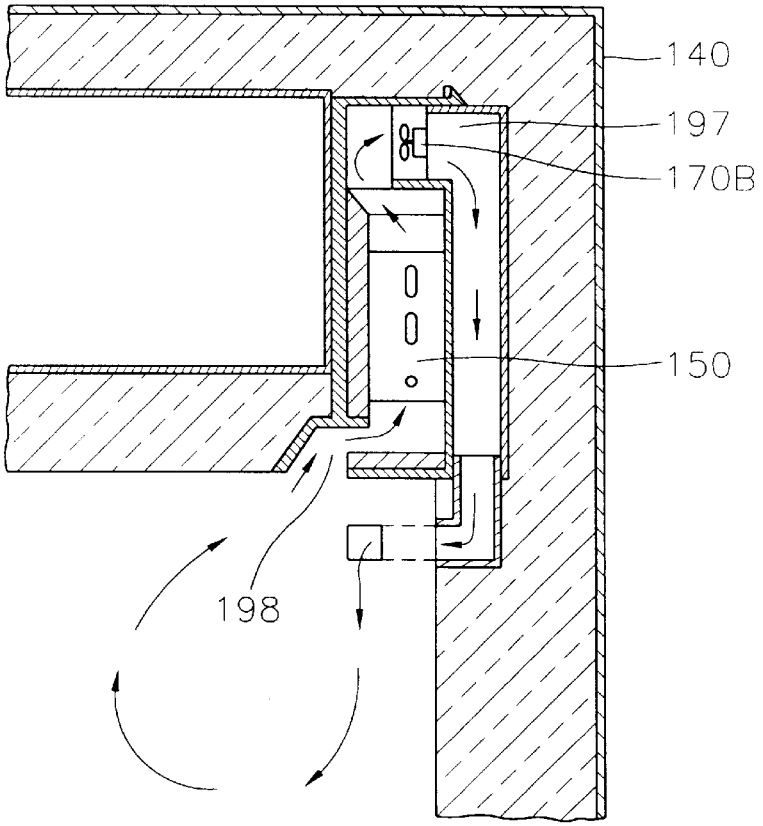
FIG. 12 is a longitudinal-sectional view for showing air circulation in a refrigerating compartment of air-circulated refrigerator according to the present invention.

FIG. 12 is a longitudinal sectional view for illustrating the air circulation in the refrigerating compartment. As shown in FIG. 12, the cooled air passed through the evaporator 150 is flowed by the second fan 170B installed in the air duct cover 190 through the air passages formed in the main air duct 160, and then is introduced into the refrigerating compartment 130 through the air guide duct 165A and 165B. The air introduced into the refrigerating compartment 130, after circulating in the refrigerating compartment 130, returns to the evaporator 150 through the fourth opening 184 formed in the upper surface of the refrigerating compartment 184 and the seventh opening 198 of the air duct cover 190.

Hereinafter, the assembling process of the air-circulated refrigerator 200 according to the present invention will be briefly explained. Firstly, the evaporator 150 is mounted by screws to the through-holes 163 formed at the upper and lower portions of both sides of the main air duct 160. Thereafter, the first and second fans 170A and 170B are installed in the main duct 160, to which the evaporator 150 is mounted. One end of each of air guide ducts 165A and 165B is inserted into the air passages 164A and 164B at each of the right and left lower corner portions of the main air duct 160, and the other end thereof is inserted into the third openings 183A and 183B formed at the right and left side walls of the refrigerating compartment 130. After the air duct cover insulation member 115 is interposed between the main air duct 160 and the air duct cover 190, the air duct cover 190 is engaged with the main air duct 160.

As above-described, since the refrigerator according to the embodiment of the present invention does not need a conventional separate partition having air passages formed therein, it can be assembled easily and promptly. Further, instead of the conventional partition, a partitioning portion filled with an insulation is provided between the freezer and refrigerating compartments so the compartments are effectively insulated. In addition, since the heattransfer coefficient of the insulation used in the refrigerator according to the present invention is smaller than that of the conventional insulation, portions filled with the insulation can be thinner than ever, so that the compartments are space-efficient.

Although the preferred embodiment of the invention has been described, it is understood that the present invention should not be limited to this preferred embodiment, but various changes and modifications can be made by one skilled in the art within the spirit and scope of the invention as hereinafter claimed.

What is claimed is:

1. An air-circulated refrigerator comprising:

an outer box having a substantially box-like shape with a front side thereof open;

an inner box provided in the outer box and having a substantially box-like shape with a front side thereof open, the inner box having an upper space and a lower space defined by a partitioning portion integrally formed therewith and filled with an insulation material, the lower space forming a refrigerating compartment, the insulation material being filled between the inner and outer boxes;

a freezer compartment case provided in the upper space, for defining a freezer compartment in the upper space by an upper surface of the inner box, side surfaces of the inner box, and an upper surface of the partitioning portion;

an evaporator installed in the upper space and at a rear side of the freezer compartment case, for cooling air using a refrigerating cycle;

first and second fans installed above the evaporator, for respectively blowing a cooled air into the freezer and refrigerating compartments; and an air duct assembly for providing air passages through which the cooled air is introduced into the freezer and refrigerating compartments, the air duct assembly having a main air duct on which the evaporator is mounted, an air duct cover engaged with the main air duct, and an air duct insulation member inserted into the air passages such that an upper plane thereof is levelled with an upper plane of the main air duct, for reducing a heat-transfer between the evaporator and the cooled air in the air passages of the main air duct, the first and second fans being installed at a rear side of the air duct cover.

2. An air-circulated refrigerator according to claim 1, wherein the freezer compartment has:

a first opening located at an upper portion of a rear wall of the freezer compartment, through which the cooled air is introduced into the freezer compartment by the first fan; and second openings respectively located adjacent to each rear corners of a bottom surface of the freezer compartment, through which the cooled air circulated in the freezer compartment returns to the evaporator.

3. An air-circulated refrigerator according to claim 1, wherein said refrigerating compartment has:

third openings located in each side wall of the refrigerating compartment, through which the cooled air is introduced into the refrigerating compartment by the second fan; and a fourth opening located at an upper portion of a rear wall of the refrigerating compartment, through which the cooled air circulated in the refrigerating compartment returns to the evaporator.

4. An air-circulated refrigerator according to claim 1, wherein the insulation material is comprised of polyurethane.

5. An air-circulated refrigerator according to claim 1, wherein the main air duct has:

air passages bifurcated and extended from an upper end of the main air duct to a lower end of the main air duct so that the cooled air is flowed therethrough to the refrigerating compartment; and engaging portions formed at upper, right, and left edges of the main air duct, for engaging with the air duct cover.

6. An air-circulated refrigerator according to claim 5, wherein the air duct assembly further comprises right and left air guide ducts, in which a first end of each of the air guide ducts is inserted into and communicated with each of the corresponding air passages at lower right and left corner portions of the main air duct, and a second end of each of the air guide ducts is inserted into each of the third openings of the refrigerating compartment so as to be communicated with the refrigerating compartment.

7. An air-circulated refrigerator according to claim 5, wherein the air duct cover has:

a fifth opening located at an upper left portion of the air duct cover, the fifth opening being connected to and communicated with the first opening;

sixth openings located at each side of a lower portion of the air duct cover, the sixth openings being respectively connected to and communicated with the corresponding second openings; and a seventh opening located in a middle of the lower portion of the air duct cover and connected to and communicated with the fourth opening.

8. An air-circulated refrigerator according to claim 5, wherein holes are respectively formed in the engaging portions of the main air duct, the air duct cover having hook members respectively located at positions corresponding to the engaging portions so as to be engaged with the corresponding holes of the engaging portions.

9. An air-circulated refrigerator according to claim 5, wherein the air duct assembly further comprises an air duct cover insulation member attached to a rear surface of the air duct cover to insulate the air duct cover from the evaporator so that generation of frost on a surfaces of the air duct cover is prevented.

10. An air-circulated refrigerator according to claim 9, wherein the air duct cover insulation member has:

eighth openings located at each side of a lower portion of the air duct cover insulation member, the eighth openings being connected to and communicated with the corresponding sixth openings formed in the air duct cover; and a ninth opening located in a middle of the lower portion of the air duct cover insulation member, the ninth opening being connected to and communicated with the seventh opening formed in the air duct cover.

11. An air-circulated refrigerator comprising:

an outer box having a substantially box-like shape with a front side thereof open;

an inner box provided in the outer box and having a substantially box-like shape with a front side thereof open, the inner box having an upper space and a lower space defined by a partitioning portion integrally formed therewith and filled with an insulation material, the lower space forming a refrigerating compartment, the insulation material being filled between the inner and outer boxes;

a freezer compartment case provided in the upper space, for defining a freezer compartment in the upper space by an upper surface of the inner box, side surfaces of the inner box, and an upper surface of the partitioning portion;

an evaporator installed in the upper space and at a rear side of the freezer compartment case, for cooling air using a refrigerating cycle;

first and second fans installed above the evaporator, for respectively blowing a cooled air into the freezer and refrigerating compartments; and an air duct assembly for providing air passages through which the cooled air is introduced into the freezer and refrigerating compartments, wherein the freezer compartment has a first opening located at an upper portion of a rear wall of the freezer compartment, through which the cooled air is introduced into the freezer compartment by the first fan and second openings respectively located adjacent to each rear corners of a bottom surface of the freezer compartment, through which the cooled air circulated in the freezer compartment returns to the evaporator, and said refrigerating compartment has third openings located in each side wall of the refrigerating compartment, through which the cooled air is introduced into the refrigerating compartment by the second fan and a fourth opening located at an upper portion of a rear wall of the refrigerating compartment, through which the cooled air circulated in the refrigerating compartment returns to the evaporator.

12. An air-circulated refrigerator according to claim 11, wherein the air duct assembly comprises:

a main air duct to which said evaporator is mounted;

an air duct cover engaged with the main air duct, the first and second fans being installed at a rear side of the air duct cover;

right and left air guide ducts, in which a first end of each of the air guide ducts is inserted into and communicated with each of the corresponding air passages at lower right and left corner portions of the main air duct, and a second end of each of the air guide ducts is inserted into each of the third openings of the refrigerating compartment so as to be communicated with the refrigerating compartment; and an air duct cover insulation member attached to a rear surface of the air duct cover to insulate the air duct cover from the evaporator so that generation of frost on the surfaces of the air duct cover is prevented.

13. An air-circulated refrigerator according to claim 12, wherein the main air duct has:

air passages bifurcated and extended from an upper end of the main air duct to a lower end of the main air duct so that the cooled air is flowed therethrough to the refrigerating compartment; and engaging portions formed at upper, right, and left edges of the main air duct, for engaging with the air duct cover.

14. An air-circulated refrigerator according to claim 12, wherein the air duct cover has:

a fifth opening located at an upper left portion of the air duct cover, the fifth opening being connected to and communicated with the first opening;

sixth openings located at each side of a lower portion of the air duct cover, the sixth openings being respectively connected to and communicated with the corresponding second openings; and a seventh opening located in a middle of the lower portion of the air duct cover and connected to and communicated with the fourth opening.

15. An air-circulated refrigerator according to claim 12, wherein holes are respectively formed in the engaging portions of the main air duct, the air duct cover having hook members respectively located at positions corresponding to the engaging portions so as to be engaged with the corresponding holes of the engaging portions.

16. An air-circulated refrigerator according to claim 12, wherein the air duct assembly further comprises an air duct cover insulation member inserted into the air passages such that an upper plane thereof is levelled with an upper plane of the main air duct, for reducing a heat-transfer between the evaporator and the cooled air in the air passages of the main air duct.

17. An air-circulated refrigerator according to claim 16, wherein the air duct cover insulation member has:

eighth openings located at each side of a lower portion of the air duct cover insulation member, the eighth openings being connected to and communicated with the corresponding sixth openings formed in the air duct cover; and a ninth opening located in the middle of the lower portion of the air duct cover insulation member, the ninth opening being connected to and communicated with the seventh opening formed in the air duct cover.

* * * * *